United States Patent [19]

Silva, deceased et al.

[11] 4,205,841

[45] Jun. 3, 1980

[54] GOLF TEE

[75] Inventors: William L. Silva, deceased, late of Stockton, Calif.; by Anthony L. Silva, successor, Lathrop, Calif.

[73] Assignee: Robert B. Uvalles, Stockton, Calif. ; a part interest

[21] Appl. No.: 922,666

[22] Filed: Jul. 7, 1978

[51] Int. Cl.[2] ..... A63B 57/00

[52] U.S. Cl. ..... 273/33

[58] Field of Search ..... 273/33, 200 R, 200 A, 273/200 B, 202, 203, 204, 205, 206, 207, 208, 209, 210, 211, 212

[56] References Cited

U.S. PATENT DOCUMENTS

| | | | |
|---|---|---|---|
| 1,595,130 | 8/1926 | Wilcox | 273/204 |
| 1,976,316 | 10/1934 | Whitelaw | 273/33 |
| 2,082,811 | 6/1937 | Thorup | 273/33 |
| 2,096,055 | 10/1937 | Miller | 273/205 |
| 2,451,311 | 10/1948 | Anderson, Sr. | 273/33 |
| 2,469,928 | 5/1949 | Marsch | 273/33 |
| 2,469,928 | 5/1949 | Mursch | 273/205 |
| 2,508,155 | 5/1950 | Gerlach | 273/205 |
| 3,424,457 | 1/1969 | Robertson | 273/33 |
| 3,575,420 | 4/1971 | Turner | 273/207 |
| 3,907,289 | 9/1975 | Bondu | 273/33 |

FOREIGN PATENT DOCUMENTS

| | | | |
|---|---|---|---|
| 305820 | 2/1929 | United Kingdom | 273/33 |
| 445026 | 4/1936 | United Kingdom | 273/211 |

*Primary Examiner*—Richard C. Pinkham
*Assistant Examiner*—T. Brown
*Attorney, Agent, or Firm*—Roger B. Webster

[57] ABSTRACT

A one-piece, re-usable, golf ball tee, preferably of stiff, high impact resistant plastic, comprising an initially aboveground golf ball cradle, and ground-engaging means provided with a downwardly yieldable, cradle-supporting arm; the arm being positioned to be struck by a fast-moving golf club head at a point rearwardly of the cradle and prior to the club head striking the ball whereby the arm and cradle are instantly forcefully depressed and the golf ball is momentarily suspended in air when struck by the club head; the tee including a prong depending from the cradle and adapted to penetrate the ground and to prevent upward rebound of the cradle when so depressed.

2 Claims, 3 Drawing Figures

FIG-1
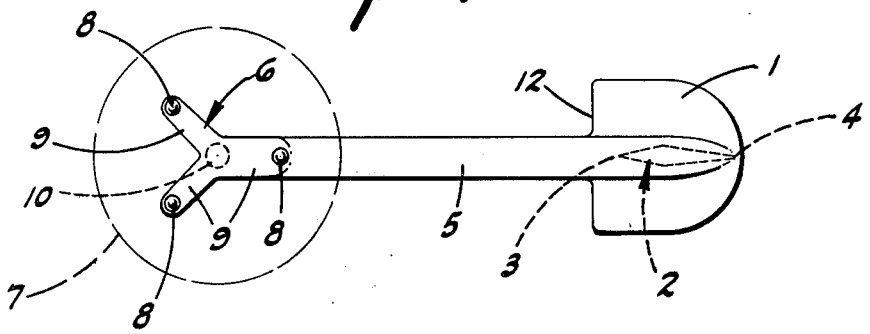
FIG-2
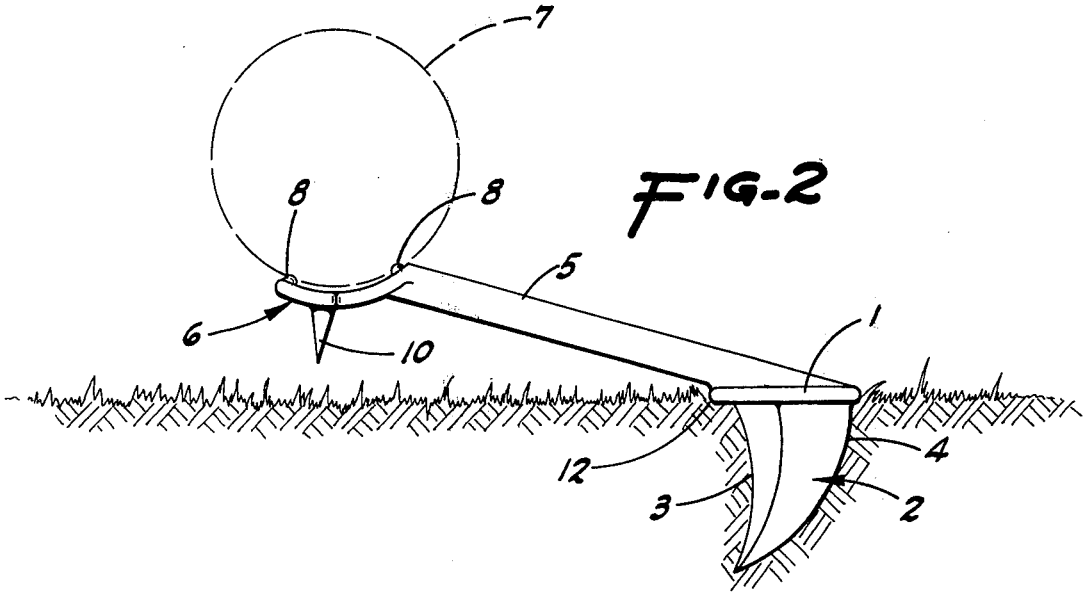
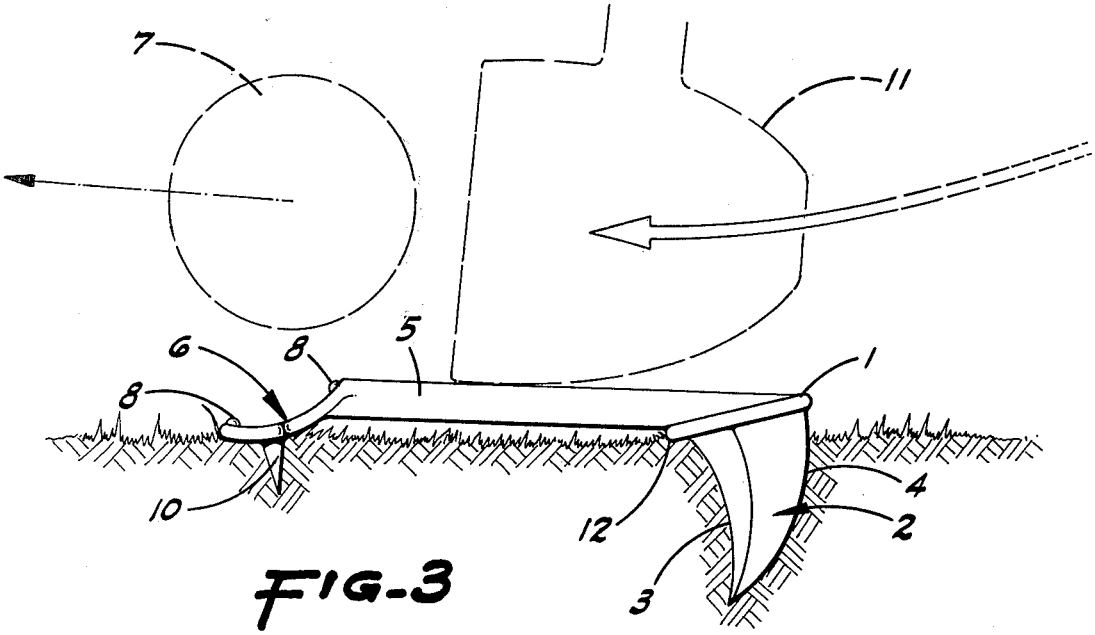
FIG-3

GOLF TEE

BACKGROUND OF THE INVENTION

1. Field of the Invention

While golf tees with a downwardly yieldable golf ball supporting cup or cradle have heretofore been known, such tees have not met with entire success in that they were either impractical in use or too fragile. The present invention was conceived in a successful effort to provide a golf tee, of the type described, which meets the requirements of practical and effective use.

2. The Prior Art

U.S. Pat. Nos. 1,595,130; 1,976,316; 2,082,811; 2,451,311; 2,469,928; 2,508,155; 3,424,457 and 3,907,289 represent the most relevant prior art known to applicant.

The above prior art—considered singly or together—does not anticipate, nor suggest as obvious, the specific and particular structure of the herein-claimed golf tee, and applicant has no knowledge of any prior art disclosing such specific and particular structure.

SUMMARY OF THE INVENTION

The present invention provides, as a major object, a one-piece, re-usable, golf ball tee, preferably of stiff, high impact resistant plastic, comprising an initially aboveground golf ball cradle, and ground-engaging means provided with a downwardly yieldable, cradle-supporting arm; the arm being positioned to be struck by a fast-moving golf club head at a point rearwardly of the cradle and prior to the club head striking the ball whereby the arm and cradle are instantly forcefully depressed and the golf ball is momentarily suspended in air when struck by the club head; the tee including means to prevent upward rebound of the cradle when so depressed.

The present invention provides, as a further object, a golf tee which is designed for ease and economy of manufacture.

The present invention provides, as a still further object, a practical, reliable, and durable golf tee, and one which is exceedingly effective for the purpose for which it is designed.

BRIEF DESCRIPTION OF THE DRAWINGS

FIG. 1 is a top plan view—on substantially full scale—of the present golf tee.

FIG. 2 is a side elevation of the tee as initially positioned on the ground with a golf ball on the cradle.

FIG. 3 is a similar view but shows the arm and cradle as depressed by the golf club head immediately prior to such head striking the ball then in air suspension.

DESCRIPTION OF THE PREFERRED EMBODIMENT

Referring now more particularly to the drawings and to the characters of reference marked thereon, the tee of the present invention (described as initially positioned for use) comprises a flat pad 1 which rests flush on the ground; there being a depending blade 2 integral with the bottom of such pad, and the blade being manually penetrated into the ground in pad-stabilizing relation. The blade, which is forwardly and downwardly somewhat arcuate, is formed so that its forward and rear edges, 3 and 4, respectively, are relatively sharp; the blade being pointed at its lower end as shown.

An arm 5 extends, in integral relation, from the top of pad 1 at a forward and upward incline, and—at its upper or aboveground end—the are is formed with an integral, golf ball supporting cradle indicated generally at 6. The golf ball 7 rests on upstanding nubs 8 on the outer ends of equidistantly spaced, radial fingers 9 which define the cradle 6.

A prong 10 is formed integral with and depends centrally from the cradle 6; such prong 10 being of a length such that its lower end clears the ground some distance when the cradle 6 is in its initial position.

When the player swings the golf club (shown only in part), the club head 11 first strikes the arm 5 at a point rearwardly of the cradle 6 in the manner shown in FIG. 3; this instantly forcefully depressing said arm and cradle. Upon such occurrence, the golf ball 7 (due to gravitational lag) is momentarily suspended in air, and—as so suspended—is Then struck by the fast-moving club head 11.

When the arm 5 and cradle 6 are forcefully depressed—as above described—the pad 1 rocks forwardly and upwardly about its front edge 12 as a fulcrum; the sharp-edged blade 2 shifts slightly rearwardly and upwardly in the ground; and the prong 10 is driven into the ground for the purpose of holding the cradle depressed against the ground and against the possibility of upward rebound, and which would interfere with proper striking of the air-suspended golf ball by the club head 11 and the "follow through" of the latter.

The advantages of the above-described golf tee reside in improved and more precise driving and lofting tee shots; greater ball impact is attained; the tee remains in place during tee shots; the turf is protected against divots; and the tee is substantially unbreakable and hence re-usable.

From the foregoing description it will be readily seen that there has been produced such a golf tee as substantially fulfills the objects of the invention as set forth herein.

While this specification sets forth in detail the present and preferred construction of the golf tee, still in practice such deviations from such detail may be resorted to as do not form a departure from the spirit of the invention as defined by the appended claims.

What is claimed is:

1. A one-piece, re-usable golf tee, of stiff high impact resistant material, comprising a ground-engaging pad, a blade depending from the pad for ground penetration, an arm extending at a forward and upward incline from the pad, an initially aboveground cradle on the upper end of the arm, the cradle being adapted to receive and support a golf ball, and a prong depending from the cradle; the prong extending downwardly and being substantially perpendicular to said cradle and being of a length to clear the ground when the pad is in flush engagement therewith and with the blade fully penetrating the ground, said prong engaging the ground when a golf ball is hit from said cradle and said cradle is moved downwardly as a result thereof.

2. A golf tee, as in claim 1, in which the prong depends from the cradle at a point substantially centrally beneath a golf ball supported on the cradle.

* * * * *